US005971575A

United States Patent [19]

Matubara

[11] Patent Number: 5,971,575

[45] Date of Patent: Oct. 26, 1999

[54] SHADE AND VEHICLE HEADLAMP HAVING THE SAME

[75] Inventor: Masao Matubara, Shizuoka, Japan

[73] Assignee: Koito Manufacturing Co., Ltd., Tokyo, Japan

[21] Appl. No.: 08/914,143

[22] Filed: Aug. 19, 1997

[30] Foreign Application Priority Data

Aug. 19, 1996 [JP] Japan ..... 8-235864

[51] Int. Cl.[6] ..... F21M 3/14

[52] U.S. Cl. ..... 362/510; 362/303; 362/306

[58] Field of Search ..... 362/257, 303, 362/304, 305, 351, 509, 510

[56] References Cited

U.S. PATENT DOCUMENTS 4,882,660 11/1989 Liverance ..... 362/226
5,067,054 11/1991 Oshio et al. ..... 362/61
5,111,368 5/1992 Suzuki et al. ..... 362/61
5,195,815 3/1993 Watanabe et al. ..... 362/61
5,567,033 10/1996 Tanaka et al. ..... 362/61

*Primary Examiner*—Sandra O'Shea
*Assistant Examiner*—Marshall Honeyman
*Attorney, Agent, or Firm*—Sughrue, Mion, Zinn, MacPeak & Seas, PLLC

[57] ABSTRACT

A vehicle headlamp including a bulb for emitting a light, a reflector having an optical axis and a reflecting surface for reflecting light received from the bulb in a forward direction, for a shade fitted to the reflector and shielding the light emitted from the bulb. The shade includes a light-shielding section which shields the light traveling from the bulb to lower right and left regions on the reflecting surface, a bridge section extending in a circumferential direction of the optical axis of the reflector, and mounting legs, each having a front end and a rear end, which are connected at the front ends to the bridge section and are connected at the rear ends to the reflector.

12 Claims, 5 Drawing Sheets

SHADE AND VEHICLE HEADLAMP HAVING THE SAME

BACKGROUND OF THE INVENTION

The present invention relates to a vehicle headlamp (hereinafter simply referred to as a headlamp) equipped with a shade.

In many cases, a shade is fitted to a headlamp as a member for shielding the light emitting from a bulb in a controlled manner. Although the shielding of the light directly emitted from the bulb in a forward direction of the headlamp is a representative example of the shielding control performed by the shade, the shade also shields the light which travels from the bulb to a specific region on a reflecting surface of a reflector.

One example of the latter case is control for the shielding of the light which travels from the bulb to lower left and right regions on the reflecting surface of the reflector (hereinafter simply referred to as incident light control). The incident light control is intended for creating cut lines in the distribution pattern of luminous intensity of auxiliary light. More specifically, the shade creates the cut lines, by itself, or the shade makes the cut lines which are created by the bulb, be more sharp.

In general, the shade comprises light-shielding section for shielding the light emanated from a bulb, and mount legs for supporting the light-shielding section on the reflector. In order to provide mounting strength for the shade which offers sufficient resistance to the vibration of a vehicle or impact loads, it is desirable to attach the mounting legs to an upper portion of the shade (it is further desirable to attach the mounting legs to several locations including the upper portion of the shade).

In the shade designed to shield the light which enters the lower right and left regions on the reflecting surface, the light-shielding section is formed so as to shield the light that travels from the bulb to the lower left and right regions on the reflecting surface. Therefore, the mounting legs cannot be connected to the upper portion of the shade where the light-shielding section is not present. As a result, there is insufficient mounting strength for the shade.

Further, in many cases, the mounting legs are fixed to the reflector in the vicinity of a bulb insertion aperture formed in the rearmost portion of the reflector. In a case where a plurality of mounting legs are connected to the rear end of the light-shielding section, it is difficult to ensure a space for fixing the mounting legs because of limitations of space due to the presence of a bulb fitting structure provided in the rearmost portion of the reflector.

SUMMARY OF THE INVENTION

The present invention has been contrived in view of the foregoing circumstance and the object of the present invention is to provide a vehicle headlamp equipped with a shade designed so as to shield light entering lower right and left regions on a reflecting surface, wherein sufficient mounting strength can be provided for the shade and the degree of freedom in mounting the shade can be improved.

To achieve the object, the present invention provides a predetermined bridge section for the shade.

More specifically, in accordance with a first aspect of the present invention, there is provided a vehicle headlamp including a bulb, a reflector with a reflecting surface for reflecting light received from the bulb in a forward direction, and a shade which is fitted to the reflector and shields the light emitted from the bulb, wherein the shade further comprises a light-shielding section which shields the light traveling from the bulb to the lower right and left regions on the reflecting surface, a bridge section extending in the circumferential direction of the optical axis of the reflector, and mounting legs which are connected at the front ends to the bridge section and are connected at the rear ends to the reflector.

Although the previously-described "light-shielding section" is intended for shielding the light traveling from the bulb to the lower right and left regions on the reflecting surface of the reflector, another light-shielding section (e.g., a light-shielding section for shielding the light traveling to another predetermined region on the reflecting surface of the reflector or a light-shielding section for shielding the light directly emitted from the bulb in a forward direction of the headlamp) may be preferably attached to the shade in addition to the previously-described light-shielding section.

The profile of the foregoing "bridge" is not limited to any particular profile, so long as it is extended in the circumferential direction of the optical axis of the reflector so as to connect together a pair of upper edges of the light-shielding section.

The foregoing "mounting legs" are connected at the front ends to the bridge section. For mounting legs other than these mounting legs, they are not particularly limited with regard to the number of the legs and the positions where they are mounted.

In a case where the light-shielding section that shields the light traveling from the bulb to the lower right and left regions on the reflecting surface of the reflector is provided for the shade for purposes of creating cut lines in the luminous-intensity distribution pattern, the mounting legs cannot be attached to the upper portion of the shade where the light-shielding section is not present by only directly connecting to the light-shielding section the mounting legs for supporting the light-shielding section on the reflector. As a result, sufficient mounting length cannot be provided for the shade, and a space for fixing the mounting legs is not easy to ensure in the reflector.

In this respect, the shade, in accordance with the present invention, has the bridge section which extends in the circumferential direction of the optical axis of the reflector so as to connect the pair of upper edges of the light-shielding section. Therefore, the mounting legs can be fixed to the upper portion of the shade. As a result, a mounting strength is ensured, and this offers sufficient resistance to the vibration of the vehicle or impact loads, and the space for fixing the mounting legs can be readily ensured in the reflector.

Consequently, in accordance with the present invention, in a headlamp equipped with the shade designed to perform the incident light control, sufficient mounting length is provided for the shade, and the degree of freedom in mounting can be also improved.

The positions where "mounting legs" are fixed are not limited to any particular positions, so long as the mounting legs are connected at the front ends to the bridge section. More preferably, as previously described, it is desirable to provide the mounting legs in the range of positions which are spaced an angle of 45° away from the vertical line passing through the optical axis in both clockwise and counterclockwise directions.

The positions of the "pair of upper edges" of the light-shielding section are not particularly limited, so long as the upper edges are positioned so that the light-shielding section can shield the light traveling from the bulb to the lower right and left regions on the reflecting surface of the reflector. More preferably, as previously described, if the pair of upper edges are positioned in the range of positions which are spaced an angle of 30° away from the horizontal line passing through the optical axis in both clockwise and counterclockwise directions, cut lines can be readily created in the luminous-intensity distribution pattern.

The "light-shielding section, bridge section, and mounting legs" that form the shade may be made by welding together individually-formed components. Alternately, they may be formed from a single member. In the latter case, as a matter of course, they may be integrally formed by pressing. Preferably, as previously described, if they are integrally formed by rolling, they can be inexpensively manufactured.

As previously described, if the bridge section is provided in such a way that the rear edge of the bridge section is brought into contact with the reflector, the shade can be positioned and supported with respect to the reflector by means of the bridge section. The mounting strength for the shade can be improved to a much greater extent. Further, although steps which are undesirable in view of the distribution of luminous intensity are more likely to be formed in the reflecting surface in the vicinity of the rearmost portion of the reflector by means of the bulb fitting structure, the light emitted from the bulb can be prevented from entering the stepped area by bringing the rear edge of the bridge into contact with the reflector.

As a matter of course, the foregoing "bulb" may be an incandescent bulb such as an H4 bulb. Preferably, as previously described, in a case where the bulb is a discharge bulb, the bulb provides a considerably large luminous flux of divergent rays, and hence the amount of the light shielded by the shade is set to a large amount. Therefore, there is a tendency for the shade to become heavier. For this reason, the adoption of the construction of the headlamp, in accordance with the present invention, is very effective for the discharge bulb.

DETAILED DESCRIPTION OF THE PREFERRED EMBODIMENTS

With reference to the accompanying drawings, an embodiment of the present invention will be described.

Figure 1:
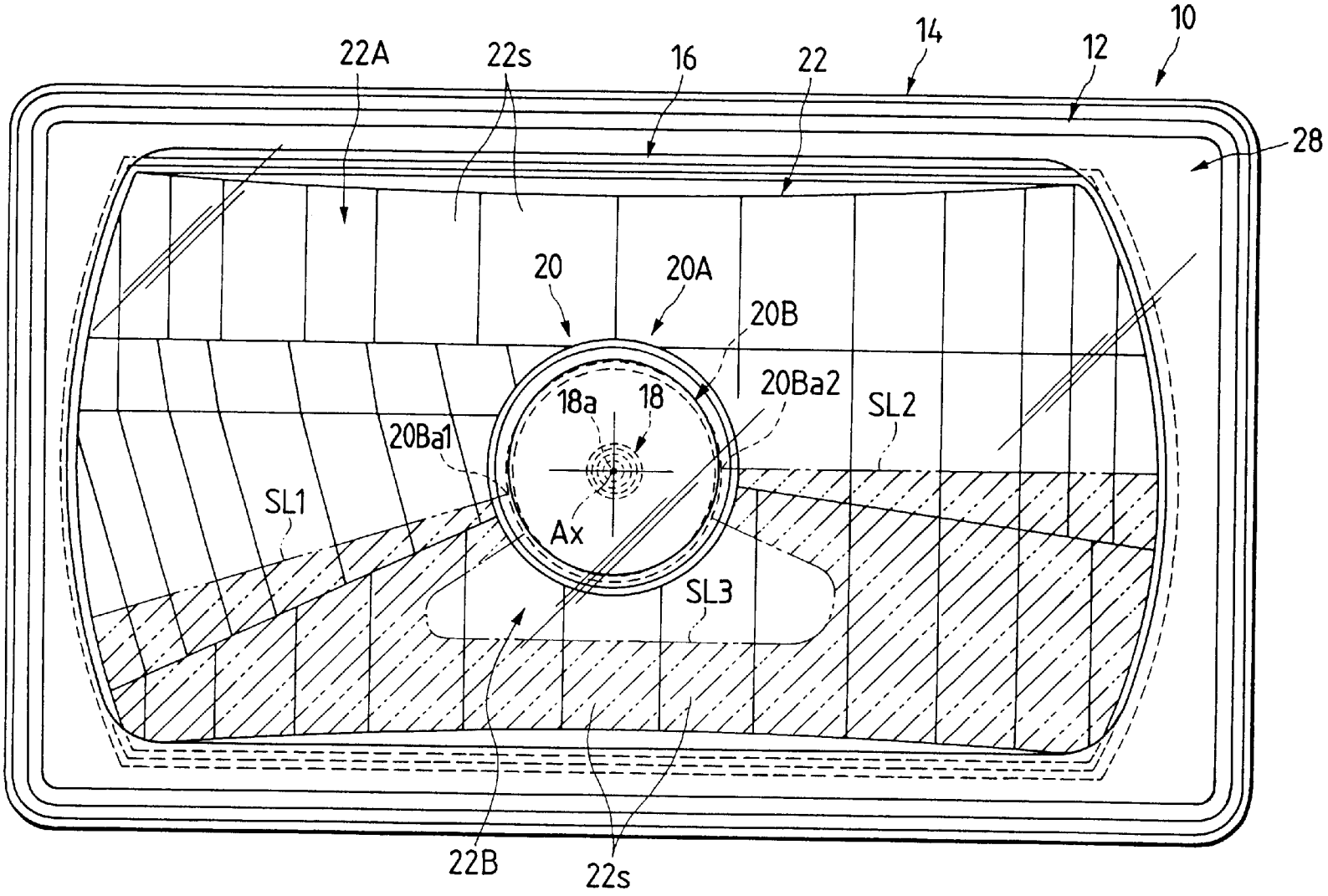
FIG. 1 is a front view illustrating a vehicle headlamp in accordance with one embodiment of the present invention.
Figure 2:
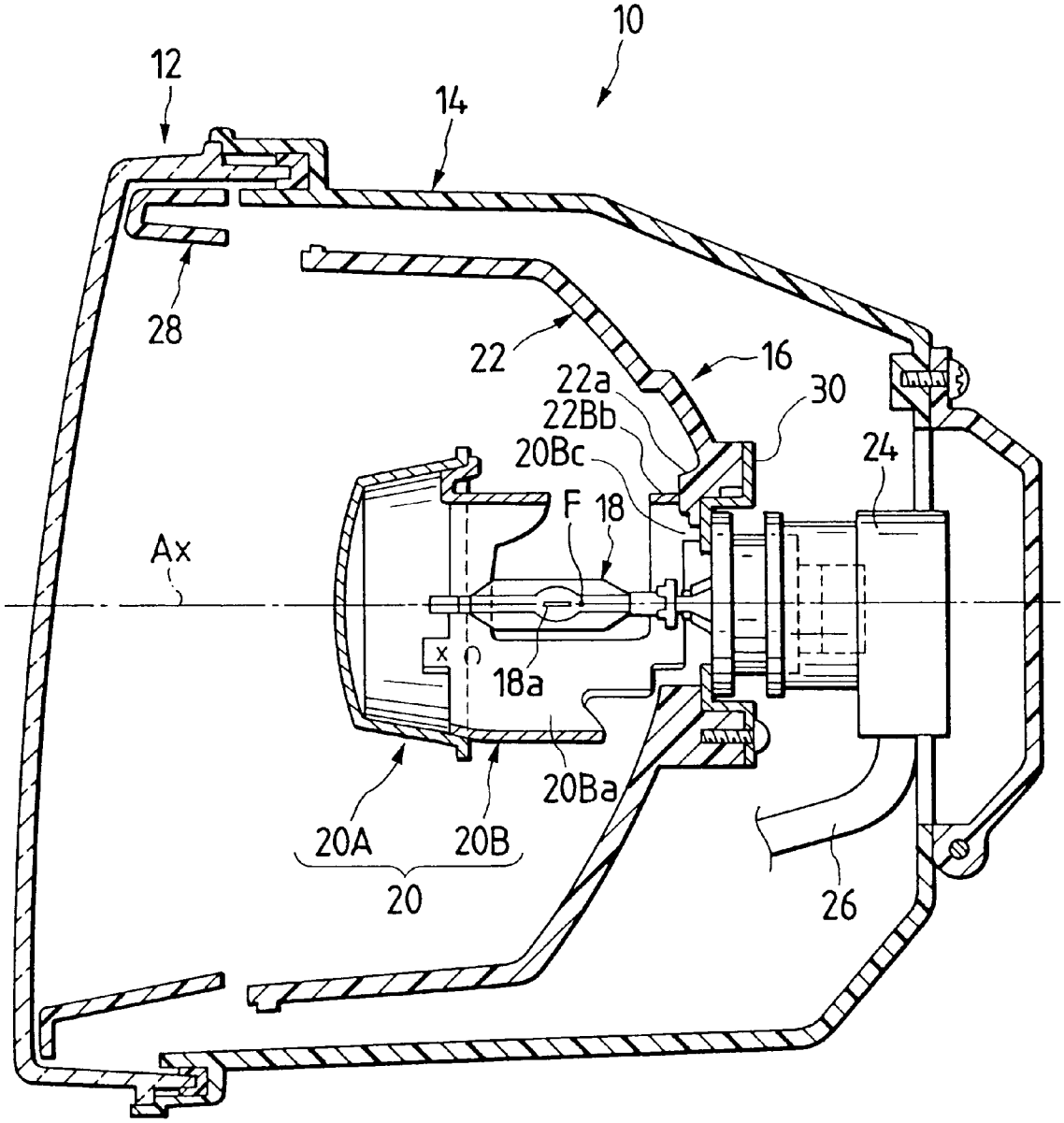
FIG. 2 is a side cross-sectional view of the headlamp.

FIG. 1 is a front view illustrating a vehicle headlamp in accordance with an embodiment of the present invention; and FIG. 2 is a side cross-sectional view of the headlamp.

As shown in these drawings, a headlamp 10 in accordance with the embodiment comprises a reflector 16 which is housed in a space defined by a lens 12 and a body 14 so as to be movable in up/down directions and right/left. The reflector 16 has a discharge bulb 18 and a shade 20. The headlamp 10 is arranged so as to form a distribution pattern of luminous intensity of auxiliary light P (hereinafter referred to as a pattern P) which has a leftwardly-offset peak and is comprised of an oblique cut line (a cut line of 15°) CL1 and a horizontal cut line CL2 shown in FIG. 3.

The lens 12 is a lens without power, and the pattern P is formed by the reflector 16.

A reflecting surface 22 of the reflector 16 is determined with reference to a paraboloid of revolution (hereinafter referred to as a reference surface) whose center axis is in alignment with an optical axis Ax of the reflector 16. The reference surface is divided into a plurality of segments, and reflecting surface elements 22s which are different in curvature from the reference surface are assigned to the segments. The pattern P is formed by setting the curvature of each of the reflecting surface elements 22s to a suitable value.

The discharge bulb 18 is a metal halide discharge bulb, and the optical axis of the discharge bulb 18 is brought into alignment with the optical axis Ax of the reflector 16. A light-emitting section (an arc) 18*a* is positioned at a position slightly in a forward direction with reference to a focal point F of the paraboloid of revolution (i.e., the reference surface) of the reflector 16. Since the discharge bulb 18 requires a high voltage for illumination, it is connected to an illumination circuit (not shown) via a bulb socket 24 and a high voltage cord 26. An extension 28 is provided in front of the reflector 16.

Figure 4:
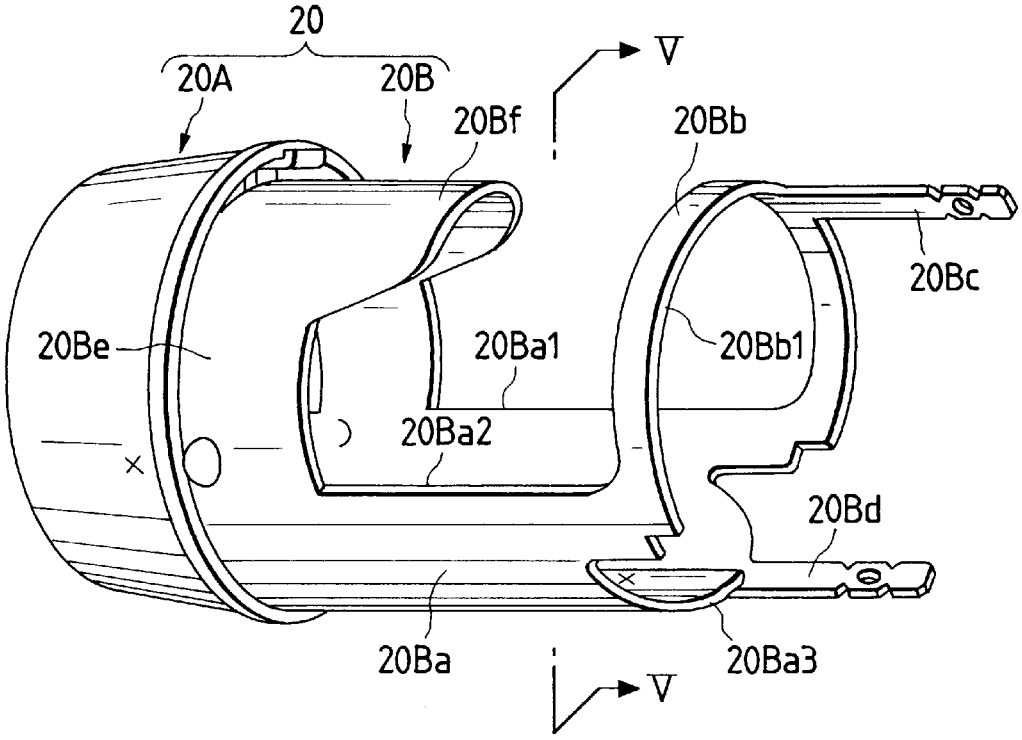
FIG. 4 is a perspective view solely illustrating a shade used in the headlamp.

As being solely illustrated in FIG. 4, the shade 20 is a metallic member comprising a cup 20A and a sleeve 20B connected together by spot-welding.

The cup 20A is formed by pressing and is provided so as to cover the area directly ahead of the discharge bulb 18, thereby shielding the direct light traveling from the light-emitting section 18*a* of the discharge bulb 18 in a forward direction.

The sleeve 20B is formed by rolling and comprises a light-shielding section 20B*a*, a bridge section 20B*b*, and two mounting legs 20B*c*, 20B*d*.

Figure 3:
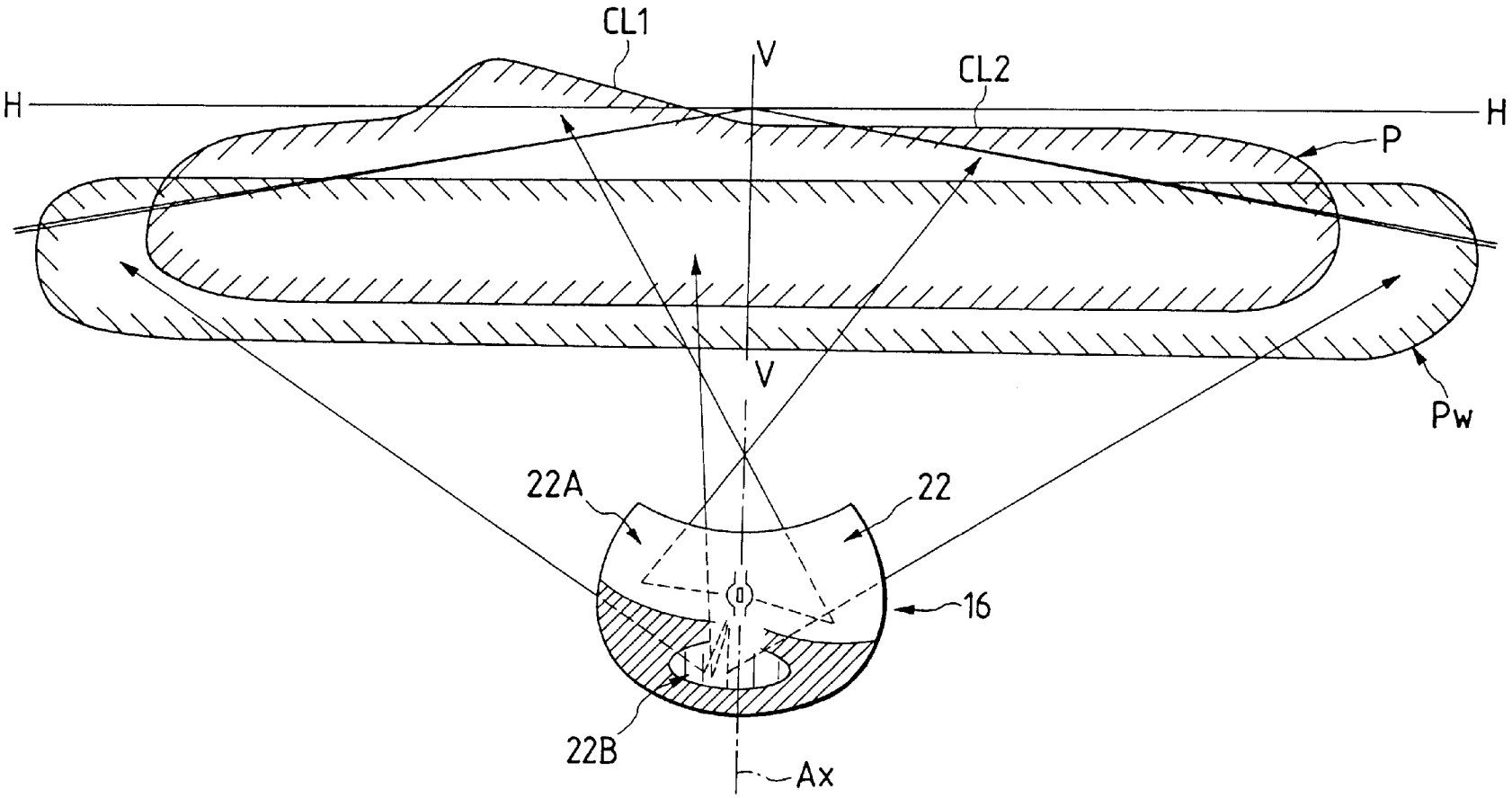
FIG. 3 is a screen pattern of distribution of luminous intensity which shows the operation of the headlamp in accordance with the embodiment.

The light-shielding section 20B*a* is formed into a semi-cylindrical shape so as to cover substantially a lower half of the discharge bulb 18, and the profile of the light-shielding section 20B*a* is determined so as to shield the light traveling from the discharge bulb 18 to lower right and left regions of and a lower area of the reflecting surface 22. The area hatched by a two-dot chain line in FIG. 1 is the area where light is prevented from entering by the presence of the light-shielding section 20B*a*. Shadow lines SL1, SL2 which form the upper-edge border lines of the hatched area are formed by a pair of upper edges 20B*a*1, 20B*a*2 of the light-shielding section 20B*a*. A contour-shaped shadow line SL3 located at the center of the reflector is formed by a lower rear edge 20B*a*3 of the light-shielding section 20B*a*. The pattern P is formed by the light reflected from a reflecting surface area 22A located at a position on the reflecting surface 22 which is higher than the shadow lines SL1, SL2. At this time, the oblique cut line CL1 and the horizontal cut line CL2 are formed by the shadow lines SL1, SL2. Further, a widely-spread distribution pattern Pw shown in FIG. 3 is additionally formed over the pattern P by means of the light reflected from a reflecting surface region 22B on the reflecting surface 22 encircled by the shadow line SL3.

A cylindrical portion 20B*e* is extended in a forward direction from the light-shielding section 20B*a* of the sleeve 20B. A protrusion 20B*f* which has a substantially circular-arc shape protrudes from an upper portion of the cylindrical portion 20B*e* in a rearward direction to thereby shield the light traveling from the discharge bulb 18 to an upper wall surface of the reflector 16.

A bridge section 20B*b* is formed into a semi-annular shape so as to connect together a pair of upper edges 20B*a*1, 20B*a*2 in the vicinity of the rear edge of the light-shielding section 20B*a*. As shown in FIG. 2, in a state where the shade 20 is attached to the reflector 16, the rear edge 20B*a*1 comes into contact with the peripheral area of the bulb insertion aperture formed in the rearmost portion of the reflector 16, thereby preventing the light traveling from the discharge bulb 18 to a stepped portion 22*a* formed in the vicinity of the rearmost portion of the reflector 16 on the reflecting surface 22.

Of the two mounting legs 20B*c*, 20B*d*, the mounting leg 20B*c* located in a higher position is connected at the front end to the bridge section 20Bb. In contrast, the mounting leg 20B*d* located in a lower position is connected at the front end to the lower rear edge 20B*a*3 of the light-shielding section 20B*a*. The mounting legs 20B*c*, 20B*d* are attached at the rear ends to the reflector 16.

While being attached to the reflector 16, the shade 20 is grounded to a vehicle body via a metallic socket fixture 30 which supports the discharge bulb 18 on the reflector 16.

Figure 5:
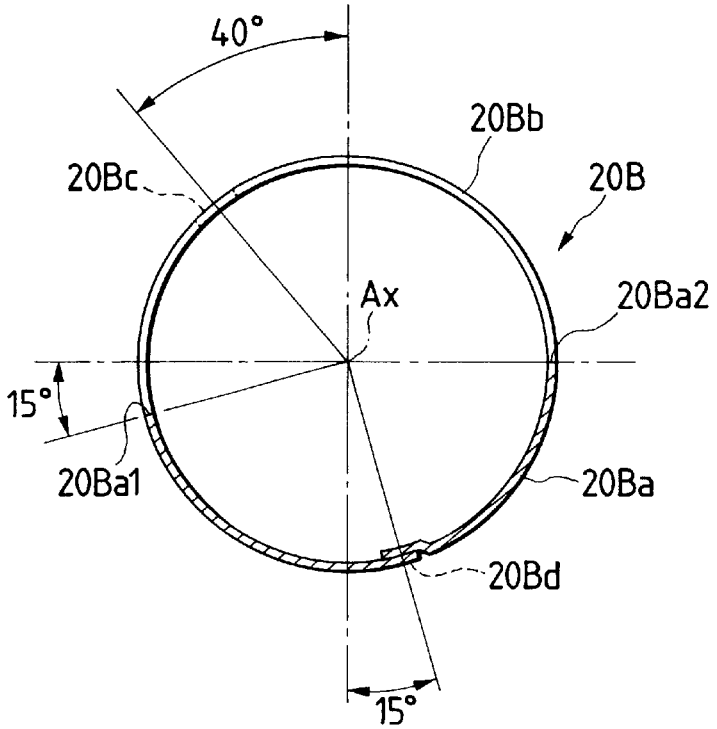
FIG. 5 is a cross-sectional view taken across line V—V in FIG. 4.
Figure 6:
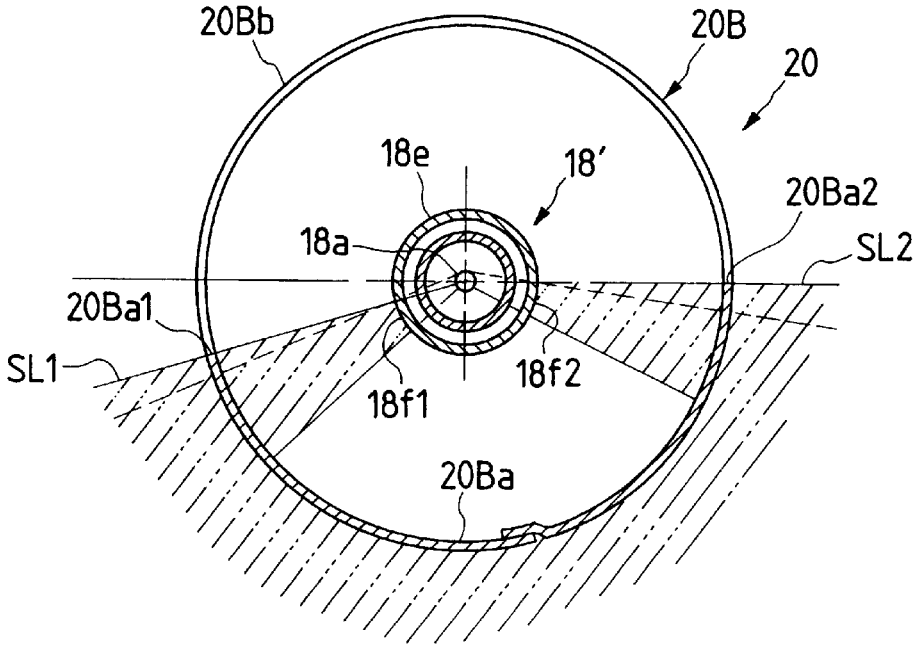
FIG. 6 is a view similar to FIG. 5, but showing a modification of the embodiment.

As shown in FIG. 5, the sleeve 20B is cylindrically formed around the optical axis Ax. The upper edge 20B*a*1 of the light-shielding section 20B*a* is formed in an angular position which is spaced an angle of 15° away from the horizontal line passing through the optical axis Ax in a clockwise direction (when viewed in the forward direction of the headlamp 10, and the same applies to the following description). The upper edge 20B*a*2 is formed in an angular position in line with the horizontal line. Further, the mounting leg 20B*c* is formed in an angular position which is spaced an angle of 40° away from the vertical line passing through the optical axis Ax in a clockwise direction. The mounting leg 20B*d* is formed in an angular position which is spaced an angle of 15° away from the vertical line in a counterclockwise direction. An overlapping area used when the sleeve 20B is made by rolling is formed in an angular position which is spaced an angle of 15° away from the vertical line in a counterclockwise direction (i.e., in the same angular position where the mounting leg 20B*d* is formed).

The operation of the headlamp 10 of the present invention will be described.

If the two mounting legs 20B*c*, 20B*d* of the sleeve 20B directly protrude from the light-shielding section 20B*a* in a rearward direction and are fixed to the reflector 16, no mounting leg can be attached to an upper portion of the shade 20 where the light-shielding section 20B*a* is not present. As a result, sufficient mounting strength cannot be provided for the shade 20. Further, it becomes difficult to ensure a space for fixing the mounting legs in the reflector 16.

In contrast, in accordance with the present embodiment, the sleeve 20B of the shade 20 has the bridge section 20B*b* which extends in a circumferential direction with respect to the optical axis Ax of the reflector 16 so as to connect together the upper edges 20B*a*1, 2B*a*2 of the light-shielding section 20B*a*. The mounting leg 20B*c* of the two mounting legs 20B*c*, 20B*d* is connected at the front end to the bridge section 20B*b* so as to be positioned in the upper portion of the shade 20. Consequently, mounting strength can be provided for the shade which offers sufficient resistance to the vibration of a vehicle or impact load. Further, the space for fixing the mounting legs 20B*c*, 20B*d* can be readily ensured in the reflector 16.

Therefore, in accordance with the present embodiment, even in the headlamp equipped with the shade designed to perform the incident light control, sufficient mounting length can be provided for the shade, and the degree of freedom in mounting the can be also improved.

Further, the shade 20 of the present embodiment is formed by connecting together a cup 20A formed by pressing and the sleeve 20B formed by rolling. Therefore, the shade 20 can be manufactured readily and inexpensively.

In the present embodiment, the bridge section 20B*b* is arranged in such a way that a rear edge 20B*b*1 of the bridge section 20B*b* is brought into contact with the peripheral area of the bulb insertion aperture formed in the rearmost portion of the reflector 16. The bridge section 20B*b* can shield the light traveling from the discharge bulb 18 to the stepped portion 22*a* in the vicinity of the rearmost portion of the reflector 16 on the reflecting surface 22, thereby ensuring prevention of the reflection or generation of upper scattered light which would otherwise cause glare. Further, the bridge section 20B*b* can support and position the shade 20 with reference to the reflector 16, and hence the mounting strength of the shade can be improved to a much greater extent.

Although the explanation has been given based on the assumption that the upper mounting leg 20B*c* is formed in an angular position which is spaced an angle of 40° away from the vertical line passing through the optical axis Ax in a clockwise direction as a matter of course, the mounting leg can be provided in another angular position other than that. The mounting leg 20B*c* is provided in an angular position where it can be easily fixed in consideration of the bulb fitting structure in the vicinity of the rearmost portion of the reflector 16. Even in this case, it is desirable to form the upper mounting leg 20B*c* in an angular position which is as close to the vertical line as possible.

Although the discharge bulb 18 used in the present embodiment is arranged so as to emit light in all directions from the light-emitting section 18*a*, there may be used a discharge bulb 18' with an outer tube 18*e* in which two black stripes (strip-shaped coating films) 18*f*1, 18*f*2 are formed. In such a case, the shadow lines SL1, SL2 can be formed by means of the black stripes 18*f*1, 18*f*2. If the shade 20 is used in conjunction with such a discharge bulb 18', the headlamp will operate in the following manner to thereby produce the following effect. More specifically, the light traveling from the upper edge of the light-emitting section 18*a* to the upper edge lines of the black stripes 18*f*1, 18*f*2 is directed in downward directions in comparison with the directions in which the shadow lines SL1, SL2 are to be formed. However, since the shade 20 is provided so as to surround the discharge bulb 18', the light directed in downward directions can be shielded by the light-shielding section 20B*a* of the sleeve 20B, whereby the shadow lines SL1, SL2 can be accurately created.

Figure 7:
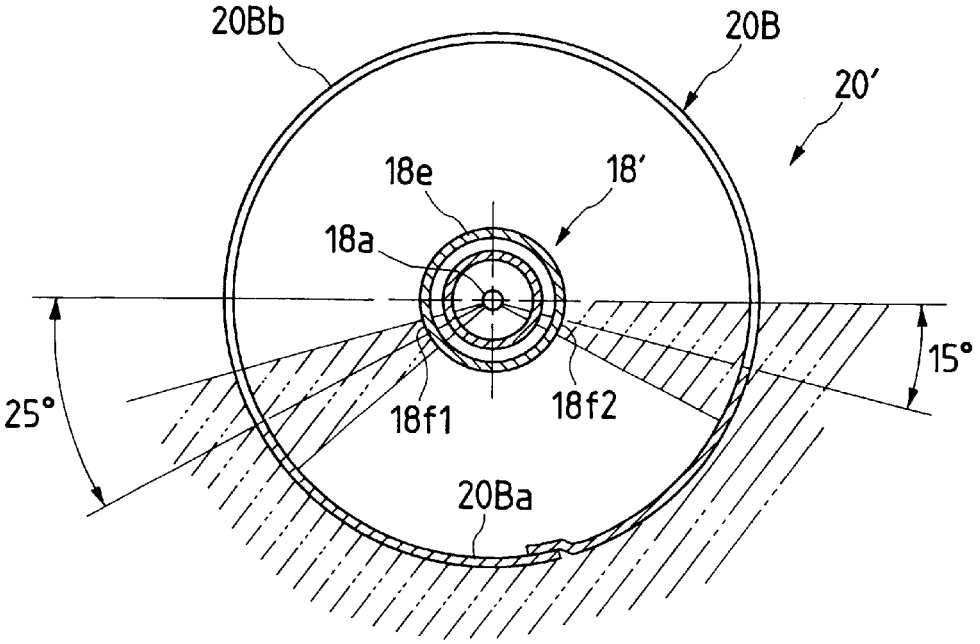
FIG. 7 is a view similar to FIG. 5, but showing another modification of the embodiment.

In a case where the discharge bulb 18' having the black stripes 18*f*1, 18*f*2 is employed, there is a chance that a shade will be provided only for the purpose of shielding the light directed in downward directions through the clearance between the black stripes 18*f*1, 18*f*2. In such a case, as shown in FIG. 7, a shade 20' can be used which has the black stripes 18*f*1, 18*f*2 in positions within the range of angles (e.g., a position spaced an angle of 25° away from the horizontal line in a clockwise direction or a position spaced an angle of 15° away from the horizontal line in a counterclockwise direction) so as to shield the upper edge lines 20B*a*, 20B*a*2 of the light-shielding section 20B*a* of the sleeve 20B. Even in this case, the headlamp 10 with this configuration can operate in the same way as does the headlamp 10 in the previous embodiment and produce the same effect with regard to the mounting strength of the shade and the degree of freedom in mounting the shade.

What is claimed is:

1. A vehicle headlamp comprising:

a bulb for emitting a light;

a reflector having an optical axis and a reflecting surface for reflecting light received from the bulb in a forward direction; and a shade fitted to the reflector and shielding the light emitted from the bulb, the shade comprising, a light-shielding section which shields the light traveling from the bulb to lower right and left regions on the reflecting surface, a bridge section extending in a circumferential direction of the optical axis of the reflector, wherein said bridge section is separate from said light-shielding section, and mounting legs, each having a front end and a rear end, which are connected at the front ends to the bridge section and are connected at the rear ends to the reflector.

2. The vehicle headlamp according to claim 1, wherein the mounting legs are positioned no further than about 45° away from a vertical line passing through the optical axis in both clockwise and counterclockwise directions.

3. The vehicle headlamp according to claim 1, wherein said light-shielding section includes a pair of upper edges, and said upper edges are positioned no further than about 30° away from a horizontal line passing through the optical axis in both clockwise and counterclockwise directions.

4. The vehicle headlamp according to claim 1, wherein the light-shielding section, the bridge section, and the mounting legs are integrally formed by rolling.

5. The vehicle headlamp according to claim 1, wherein the bridge section is provided in such a way that the rear edge of the bridge section is brought into contact with the reflector.

6. The vehicle headlamp according to claim 1, wherein the bulb is a discharge bulb.

7. A shade for a vehicle headlamp in which a reflector has an optical axis and a reflecting surface for reflecting light received from a bulb in a forward direction, and the shade is fitted to the reflector and shields the light emitted from the bulb, the shade comprising:

a light-shielding section which shields the light traveling from the bulb to lower right and left regions on the reflecting surface;

a bridge section extending in a circumferential direction of the optical axis of the reflector, wherein said bridge section is separate from said light-shielding section, and mounting legs, each having a front end and a rear end, which are connected at the front ends to the bridge section and are connected at the rear ends to the reflector.

8. The shade according to claim 7, wherein the mounting legs are positioned no further than about 45° away from a vertical line passing through the optical axis in both clockwise and counterclockwise directions.

9. The shade according to claim 7, wherein said light-shielding section includes a pair of upper edges, and said upper edges are positioned no further than about 30° away from a horizontal line passing through the optical axis in both clockwise and counterclockwise directions.

10. The shade according to claim 7, wherein the light-shielding section, the bridge section, and the mounting legs are integrally formed by rolling.

11. The shade according to claim 7, wherein the bridge section is provided in such a way that the rear edge of the bridge section is brought into contact with the reflector.

12. The shade according to claim 7, wherein the bulb is a discharge bulb.

* * * * *